US006819902B2

(12) United States Patent
Toyohara et al.

(10) Patent No.: US 6,819,902 B2
(45) Date of Patent: Nov. 16, 2004

(54) IMAGE FORMING APPARATUS WITH INTERCHANGEABLE DEVELOPING DEVICES

(75) Inventors: Yuichiro Toyohara, Kanagawa (JP); Akinori Tanaka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/396,515

(22) Filed: Mar. 26, 2003

(65) Prior Publication Data

US 2003/0185601 A1 Oct. 2, 2003

(30) Foreign Application Priority Data

Mar. 29, 2002 (JP) ..... 2002-096849
Sep. 30, 2002 (JP) ..... 2002-286804
Oct. 25, 2002 (JP) ..... 2002-311664

(51) Int. Cl.[7] ..... G03G 15/01
(52) U.S. Cl. ..... 399/298; 399/227; 399/302
(58) Field of Search ..... 399/39, 54, 223, 399/226, 227, 298, 299, 300, 302, 28, 112

(56) References Cited

U.S. PATENT DOCUMENTS 6,013,403 A * 1/2000 Ichikawa
6,240,271 B1 * 5/2001 Shimazawa et al. ..... 399/302
6,303,072 B1 10/2001 Kobayashi et al. ..... 264/564
6,327,450 B1 * 12/2001 Ito ..... 399/227
6,389,240 B2 5/2002 Toyohara et al. ..... 399/38
6,498,910 B2 * 12/2002 Haneda ..... 399/302
2001/0028805 A1 * 10/2001 Haneda

FOREIGN PATENT DOCUMENTS

JP 4-204871 7/1992
JP 11-212328 8/1999

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

The image forming apparatus is equipped with a first photosensitive member, a plurality of first developing devices, a second photosensitive member, and a second developing device. In the image forming apparatus, toner images on the first photosensitive member and the second photosensitive member are transferred onto a transfer medium while one is superimposed on the other, whereby it is possible to form a high quality image using deep-color and light-color toners of the same hue and to prevent a deterioration in gradation property.

8 Claims, 11 Drawing Sheets

IMAGE FORMING APPARATUS WITH INTERCHANGEABLE DEVELOPING DEVICES

BACKGROUND OF THE INVENTION

1. Field of the Invention

The present invention relates to an electrophotographic image forming apparatus and, in particular, to an image forming apparatus, such as a copying machine, a printer, or a facsimile apparatus.

2. Related Background Art

With recent improvements in image forming apparatuses, there is a demand for more sophisticated techniques, and, as opposed to the conventional four-color image forming apparatuses, an electrophotographic image forming apparatus using developers of an increased number of colors has been proposed and partially realized. In addition to the conventionally used four colors of cyan, magenta, yellow, and black, other colors such as red, blue, and green, and special colors such as gold, silver, and a fluorescent color, have come to be used. In the field of the ink jet system, addition of light cyan, light magenta, etc. in general terms is becoming common practice. The objective of these innovations is to achieve a differentiation in image quality.

Image forming apparatuses using developers of an increased number of colors are of various types. Regarding an image forming apparatus using developers (toners), for example, of six colors, the following possible examples for a general use may be mentioned: a tandem type image forming apparatus 101 shown in FIG. 11, in which image formation is effected by using image bearing members (photosensitive members) in a number corresponding to the number of toner colors; an image forming apparatus 102 shown in FIG. 12, in which image formation is effected by using a single photosensitive member; and an image forming apparatus 103 shown in FIG. 13, which is disclosed in Japanese Patent Application Laid-Open No. 4-204871.

The tandem type image forming apparatus 101 shown in FIG. 11 has six image bearing members 1*a*, 1*b*, 1*c*, 1*d*, 1*e*, and 1*f* and six developing devices 41, 42, 43, 44, 45, and 46 containing developers of different spectral characteristics and arranged in one-to-one correspondence with the image bearing members, with image forming means Sa, Sb, Sc, Sd, Se, and Sf, each including a combination of one image bearing member and one developing device, being arranged in series. If used on a six-color basis, this type of image forming apparatus allows image output at the same speed, which means it is a productivity-oriented apparatus.

In the image forming apparatus 102 shown in FIG. 12, six developing devices 41, 42, 43, 44, 45, and 46 are provided for a single image bearing member 1. By rotating a rotary 4 on which these developing devices 41 through 46 are mounted, an arbitrary developer is selectively positioned at a developing portion 40 opposed to the image bearing member 1, thereby effecting image formation successively. Thus, primary transfer to an intermediate transfer member 5 is effected for each color to thereby realize multiple transfer. When transfer has been completed for all the six colors, secondary transfer to a recording material is conducted. This arrangement allows output of a six-color image with minimum requisite space.

The image forming apparatus 103 shown in FIG. 13 is a compromise between the image forming apparatuses 101 and 102 shown in FIGS. 11 and 12. Arranged in the image forming apparatus 103 are two image forming means: a first image forming means Sa including a first photosensitive drum 1*a*, and a second image forming means Sb including a second photosensitive drum 1*b*. The first image forming means Sa is equipped with developing devices 41 through 43, and the second image forming means Sb is equipped with developing devices 44 through 46. This image forming apparatus, which offers a well-balanced combination of the characteristics of the above two apparatuses, has been developed with a view toward meeting demands in terms of size, cost, and speed.

However, these image forming apparatuses 101, 102, and 103, constructed as described above, have the following problems.

First, the tandem type image forming apparatus 101 shown in FIG. 11 has a problem in that it must have a large size (lateral width). Further, each of the image forming means Sa through Sf for different developers must be equipped with a primary charger, an exposure device, a developing device, a transfer charger, etc., resulting in a rather high component cost. Thus, from the viewpoint of providing a popularly priced image forming apparatus, the above-mentioned problem is serious, which means this type is rather difficult to realize at low cost.

Next, the image forming apparatus 102 shown in FIG. 12, which uses a single image bearing member 1, has a problem in terms of output speed. To form one image, the intermediate transfer member 5 has to make six rounds, with the rotary 4 being rotated in synchronism therewith for switching between the developing devices 41 through 46. Thus, even if the rotating speed of the image bearing member 1 is the same as that in the above-described image forming apparatus 101, for example, it will be seen through simple calculation that the productivity will be reduced to ⅙. This problem is also rather serious if compact, quick, and neat image formation is to be conducted with a popularly priced image forming apparatus.

Next, the image forming apparatus 103 shown in FIG. 13, which uses two photosensitive members 1*a* and 1*b*, with the developing devices 41, 42, and 43 being secured in position around the photosensitive drum 1*a* and the developing devices 44, 45, and 46 being secured in position around the photosensitive drum 1*b*, has a problem in that there is a difference between the developing devices 41, 42, and 43 or between the developing devices 44, 45, and 46 in terms of the distance to be covered between image exposure on the image bearing member 1*a* or 1*b* and development at the developing portion 40*a* or 40*b*. When the distance to be covered between exposure and development thus differs from developing device to developing device, the electrostatic latent image undergoes a change (decay) in the while, so that it is difficult to provide developer images (toner images) of the same characteristic.

It might be possible to avoid this problem through appropriate changes in high-voltage setting, etc. However, that would involve a complicated control operation wastefully requiring a memory space for storing a program for the same and control time. This waste of time would lead to an increase in the so-called first print time, that is, the period of time between the input of an image formation start signal and the discharge of the first recording material to the exterior of the image forming apparatus.

SUMMARY OF THE INVENTION

It is an object of the present invention to provide an image forming apparatus capable of forming a high-quality image using deep-color and light-color toners of the same hue.

Another object of the present invention is to provide an image forming apparatus capable of preventing a deterioration in gradation when forming an image using deep-color and light-color toners of the same hue.

Still another object of the present invention is to provide an image forming apparatus capable of preventing a deterioration in gray balance when forming an image using deep-color and light-color toners of the same hue.

Further object of the present invention will become apparent from the following detailed description.

DETAILED DESCRIPTION OF THE PREFERRED EMBODIMENTS

An image forming apparatus according to the present invention will now be described in more detail with reference to the drawings.

Embodiment 1

In the following, an embodiment of the present invention will be described in detail with reference to the drawings.

Figure 1:
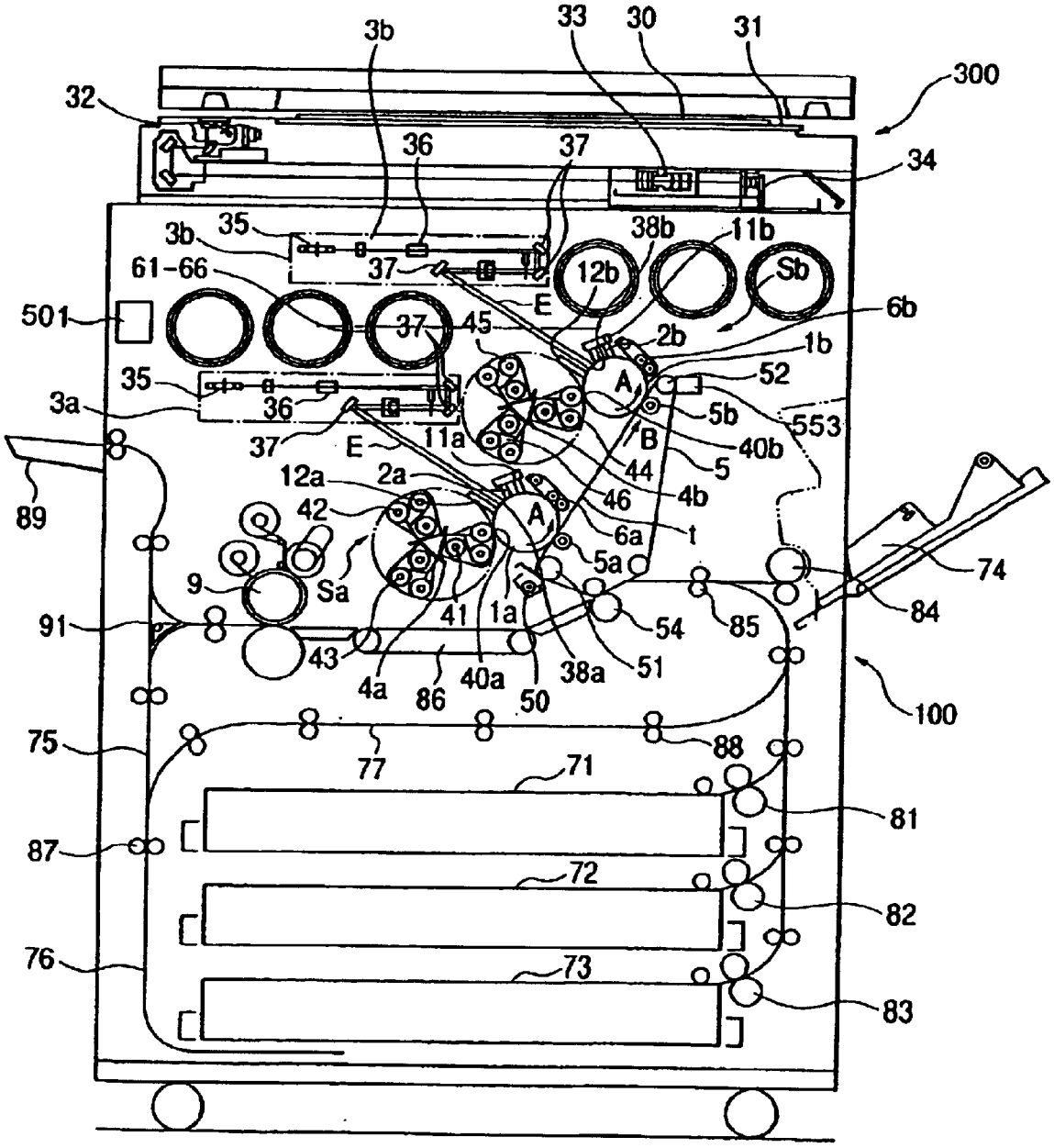
FIG. 1 is a schematic diagram showing a construction of an image forming apparatus according to the present invention.

FIG. 1 is a schematic sectional view showing a full color image forming apparatus according to an embodiment of the present invention (a multifunction apparatus functioning as a copying machine, a printer, and a facsimile apparatus). In this example, a digital color image reader portion 300 is provided in the upper portion, and a digital color image printer portion 100 is provided in the lower portion of the apparatus.

In the reader portion 300, an original 30 is placed on an original table glass (copy board glass) 31, and exposure scanning is performed thereon by an exposure lamp 32 to obtain a reflection light image from the original 30, which is condensed on a full color CCD sensor 34 by a lens 33 to thereby obtain a color separation image signal. The color separation image signal is transmitted by way of an amplification circuit (not shown) and undergoes processing in a video processing unit (not shown) before it is sent out to the printer portion 100 through an image memory (not shown).

Apart from the signal from the reader portion 300, the printer portion 100 receives an image signal from a computer, an image signal from a facsimile apparatus, etc.

Here, the operation of the printer portion 100 will be described focusing on the signal from the reader portion 300.

Roughly speaking, the printer portion 100 includes two image forming means: a first image forming means Sa including a first photosensitive drum 1*a* and a second image forming means Sb including a second photosensitive drum 1*b*. To reduce costs, these image forming means Sa and Sb are formed in substantially the same construction (configuration). For example, they have developing devices (described below) of substantially the same construction and configuration. Thus, the developing devices 41 through 46 are mutually interchangeable.

Two drum-shaped photosensitive members (photosensitive drums) serving as image bearing members, that is, a first photosensitive drum 1*a* and a second photosensitive drum 1*b* are held so as to be rotatable in the direction of the arrow A. Arranged around the photosensitive drums 1*a* and 1*b* are pre-exposure lamps 11*a* and 11*b*, a first charging means 2*a* and a second charging means 2*b* consisting of corona chargers, a first exposure means 3*a* and a second exposure means 3*b* consisting of laser exposure optical systems, potential sensors 12*a* and 12*b*, movable members (development rotaries) 4*a* and 4*b* consisting of rotary developing device retaining portions, three developing devices 41 through 43 and 44 through 46 which receive different color developers in the respective retaining portions, primary transfer rollers 5*a* and 5*b* serving as primary transfer means, and cleaning devices 6*a* and 6*b*.

For high image quality, five or more developing devices suffice. In this embodiment, six developing devices 41 through 46 are used.

The developing device 41 contains deep magenta toner, the developing device 42 contains deep cyan toner, the developing device 43 contains light magenta toner, the developing device 44 contains yellow toner, the developing device 45 contains black toner, and the developing device 46 contains light cyan toner.

The deep-color and light-color developers are prepared from pigments of substantially the same spectral characteristics (i.e., substantially the same hue) in different amounts (The variation due to an error in pigment content is not included). Thus, while a light magenta toner and ordinary magenta toner are obtained from pigments of the same spectral characteristics, the pigment content of the former is less than that of the latter. Similarly, while a light cyan toner and ordinary cyan toner are obtained from pigments of the same spectral characteristics, the pigment content of the former is less than that of the latter.

Apart from the above, it is possible to mount on the rotary development member developing devices (of the same configuration as the above ones) containing toners whose spectral characteristics are different from those of cyan, magenta, yellow and black, e.g., metallic type toners, such as gold and silver ones, and a fluorescent toner containing fluorescent agent.

Further, while these developing devices contain dual-component developers in which toners and carriers are mixed together, it is also possible to use mono-component developers containing toners but no carriers.

It is in order to achieve a dramatic improvement in the reproducibility for a light-color image like that of a human skin (i.e., to achieve a reduction in granularity) that deep-color and light-color toners are used for magenta and cyan.

In the laser exposure optical systems 3*a* and 3*b* serving as the exposure means, image signals (not shown) from the reader portion 300 are converted to optical signals at a laser output portion (not shown), and laser beams E converted to optical signals are reflected by polygon mirrors 35 and travel by way of lenses 36 and reflection mirrors 37 before being projected onto exposure positions 38*a* and 38*b* on the surfaces of the photosensitive drums 1*a* and 1*b*.

When image formation is to be effected in the printer portion 100, the photosensitive drums 1*a* and 1*b* are rotated in the direction of the arrow A, and charge removal is effected on the photosensitive drums 1*a* and 1*b* by the pre-exposure lamps 11*a* and 11*b* before the photosensitive drums 1*a* and 1*b* are uniformly charged by the chargers 2*a* and 2*b*, the light images E being applied for each separation color to form latent images on the photosensitive drums 1*a* and 1*b*.

Next, the rotary developing device retaining portions formed as movable members, that is, the first development rotary 4*a* and the second development rotary 4*b* are rotated, and predetermined ones of the retained developers, e.g., the first developers 41 and 44 are moved to the common developing portions 40*a* and 40*b* between the developing devices 41 through 43 and 44 through 46 on the photosensitive drums 1*a* and 1*b*, and then the developing devices 41 and 44 are operated to effect reversal development of the electrostatic latent images on the photosensitive drums 1*a* and 1*b*, forming developer images (toner images) mainly consisting of resin and pigment on the photosensitive drums 1*a* and 1*b*. At this time, development bias is applied to the developing devices.

Further, as shown in the drawing, whenever necessary, toners are supplied at a predetermined timing to the developing devices 41 through 46 from toner accommodating portions (hoppers) 61 through 66 for different colors arranged between the laser exposure optical systems 3*a* and 3*b* and horizontally so as to maintain a fixed toner ratio (or toner amount) in the developing devices.

The toner images formed on the photosensitive drums 1*a* and 1*b* are primarily transferred one upon the other in this order to an intermediate transfer member (intermediate transfer belt) 5 serving as a transfer medium by the primary transfer rollers 5*a* and 5*b* serving as the primary transfer means. By further repeating this twice, a toner image in six colors is formed on the intermediate transfer member 5, with the result that a full color image is formed. At this time, primary transfer bias is applied to the primary transfer rollers 5*a* and 5*b*. As a result, while the intermediate transfer belt makes three rounds, the respective toner images successively superimposed one upon the other on the intermediate transfer belt 5 to thereby form a full color toner image.

Further, there are provided the following image formation modes: a four-color mode in which image formation is effected by using deep-cyan, deep-magenta, yellow, and black toners, and a six-color mode in which image formation is effected by using toners of all the six colors. One of these modes can be designated by the user from a liquid crystal screen serving as a display portion. On the basis of this mode designation, image formation by the image forming means is controlled by a CPU 501 serving as the control means.

Thereafter, the full color toner images on the intermediate transfer belt 5 serving as a transfer medium are transferred secondarily and collectively to a sheet serving as the recording material. At this time, secondary transfer bias is applied to the secondary transfer roller 54.

The intermediate transfer belt 5 is driven by a driving roller 51, and a transfer cleaning device 50 is opposed to the driving roller 51 with the intermediate transfer belt 5 therebetween so as to be capable of moving toward and away from the driving roller 51.

The photosensitive drums 1*a* and 1*b* are provided on a transfer surface t, which is a common planar portion formed by stretching the intermediate transfer belt 5 between the two rollers 51 and 52, and primary transfer rollers 5*a* and 5*b* serving as primary transfer means are opposed to the photosensitive drums 1*a* and 1*b* with the intermediate transfer belt 5 therebetween.

Further, arranged on the downstream side with respect to the moving direction B of the intermediate transfer belt 5 forming the transfer surface t so as to be opposed to the driven roller 52, is a sensor 553 for detecting positional deviation and density of the images transferred from the drums 1*a* and 1*b*, performing, whenever necessary, control on the image forming means Sa and Sb for correction regarding toner supply amount, image write timing, image write start position, etc.

Further, after images of the requisite colors have been superimposed one upon the other on the intermediate transfer belt 5, the transfer cleaning device 50 opposed to the driving roller 51 is pressurized against the opposing driving roller 51 to remove the residual toner on the intermediate transfer belt 5 after the transfer to the recording material. After the completion of the cleaning, the transfer cleaning device 50 is separated from the intermediate transfer belt 5.

The recording sheets are transported one by one from accommodating portions 71, 72, 73, or a manual-feed tray 74 by sheet feeding means 81, 82, 83, and 84, and are corrected for skew feeding by a registration roller 85, and transported at a desired timing to a secondary transfer portion serving as a secondary transfer means for transferring the toner image on the intermediate transfer belt 5 to the recording material and situated between the secondary transfer roller 54 and the intermediate transfer belt 5.

In the secondary transfer portion, the toner image is transferred to the recording material, which passes a transport portion 86 and to which the toner image is fixed by a thermal fixing device 9 before being discharged onto a sheet display tray 89 or a sheet post-processing device (not shown).

After the secondary transfer, the residual toner on the intermediate transfer belt 5 is removed by the transfer cleaning device 50 as stated above, and the transfer belt is made ready for the next primary transfer process for the image forming means Sa and Sb.

Further, when images are to be formed on both sides of a recording material, a transport path switching guide 91 is driven immediately after the recording material has passed the fixing device 9, and the recording material is temporarily guided to a reversal path 76 by way of a transport longitudinal path 75. Then, through reverse rotation of a reversal roller 87, the sheet fed is caused to retreat in the reverse direction with the trailing edge thereof at its head, and transported to a double-side transport path 77. Thereafter, it passes the double-side transport path to undergo skewing correction and timing adjustment at a double-side transport roller 88 before being transported to the registration roller 85 at a desired timing to allow an image to be transferred to the other surface thereof by the image forming process as described above.

Figure 13:
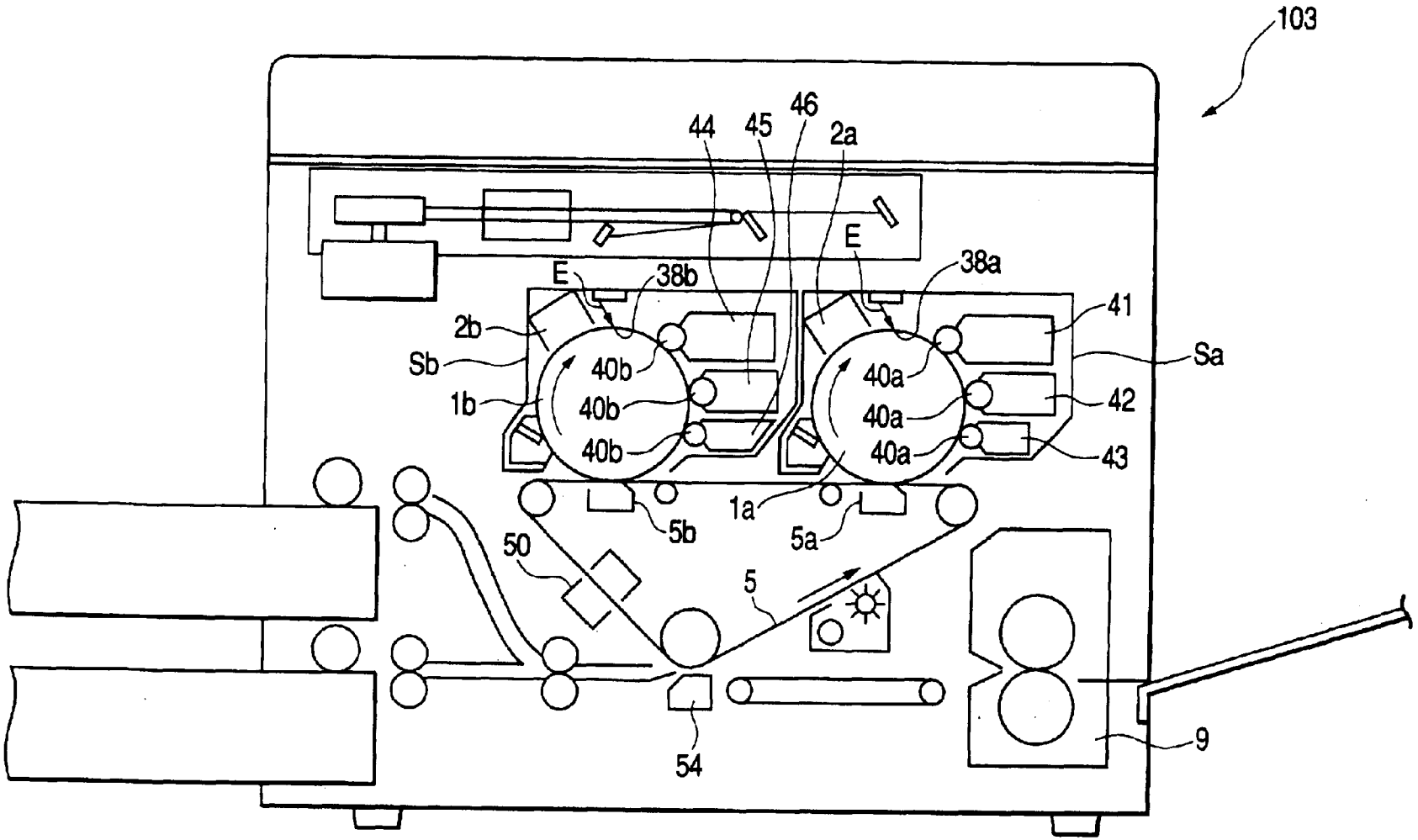
FIG. 13 is a schematic diagram showing a construction of a conventional image forming apparatus to which the present invention is applicable.

Here, the features of the present invention will be described in comparison, in particular, with the conventional image forming apparatus 103 shown in FIG. 13 having two photosensitive drums 1*a* and 1*b*. It is assumed that the image forming apparatus 103 and the image forming apparatus of this embodiment shown in FIG. 1 use photosensitive drums 1*a* and 1*b* of the same characteristics.

Figure 2:
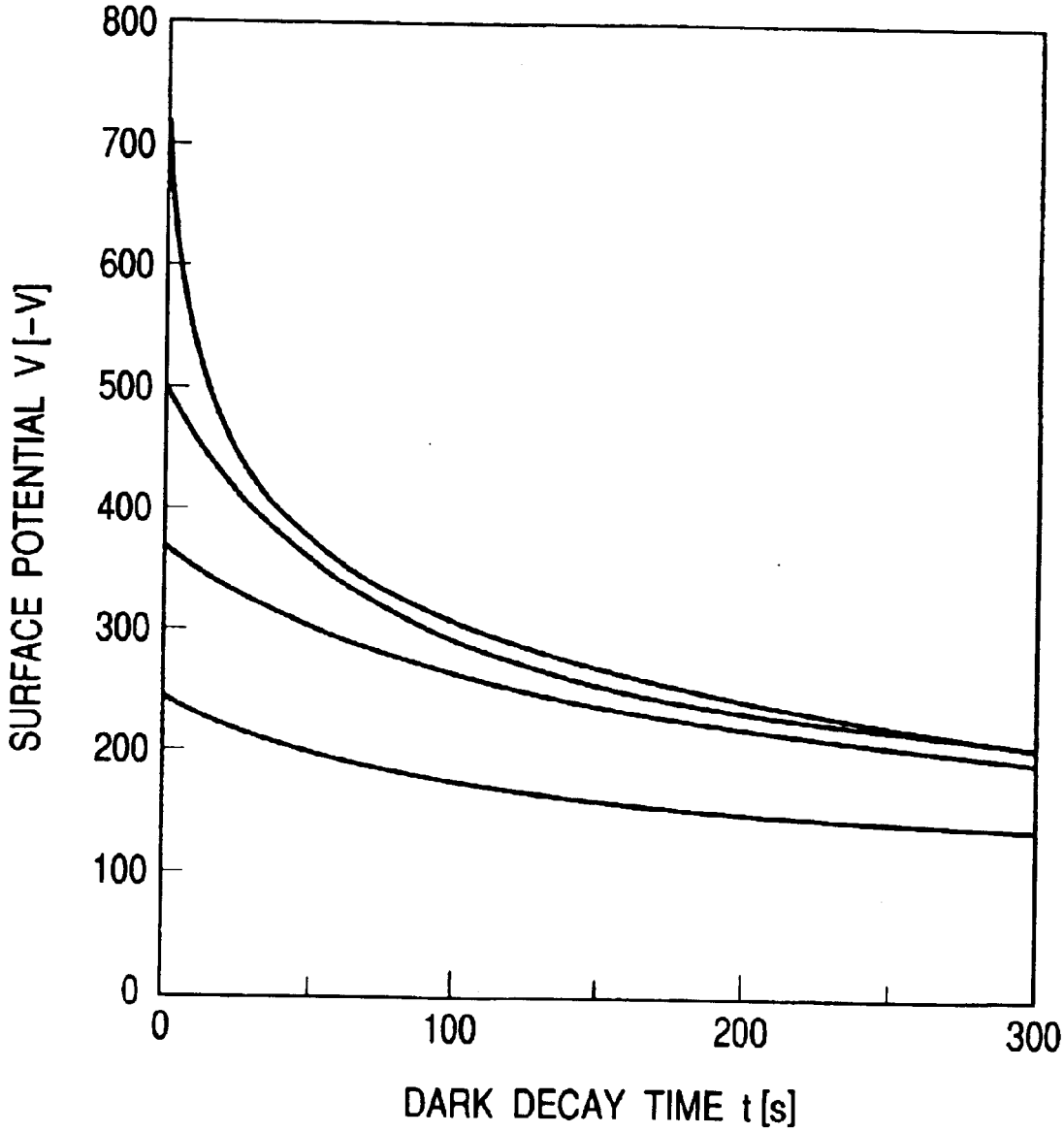
FIG. 2 is a graph showing a relationship between a surface potential of a photosensitive drum and dark decay time.

In the photosensitive drums 1*a* and 1*b* used in the present invention, the electrostatic latent images formed at the exposure positions 38*a* and 38*b* decay with passage of time. This phenomenon is generally called dark decay. As can be understood from FIG. 2 showing the relationship between the surface potential (V) of a photosensitive drum and dark decay time (t), the surface potential of the photosensitive drums 1*a* and 1*b* decays with passage of time.

As is apparent from this, the higher the primary charge potential, the larger the dark decay amount. Due to this dark decay characteristic, if the distance between the exposure position 38*a*, 38*b* for image exposure and the developing portion 40*a*, 40*b* differs, the electrostatic latent image at the developing portion 40*a*, 40*b* will vary from developing device to developing device (The image portion potential and the non-image portion potential will decay).

In the image forming apparatus 103 and the image forming apparatus of this embodiment, an organic photoconductor (OPC) is used for the photosensitive drums 1*a* and 1*b*. When an amorphous silicon photoconductor (a-Si photoconductor), which has higher durability (longer service life), is used, the dark decay occurs to a remarkable degree. However, this embodiment allows use of such an amorphous silicon photoconductor.

Further, under high temperature and humidity, the surface resistance value of the photosensitive drums 1*a* and 1*b* is reduced, so that the charge is subject to lateral displacement. This also becomes one of the factors for variation in electrostatic latent images at the developing portions 40*a* and 40*b* after image exposure due to the difference in the distance to be covered by the developing devices 41 through 46 to reach the developing portions 40*a* and 40*b*.

Further, the photosensitivity of the photosensitive drums 1*a* and 1*b* can be varied depending on the degree of wear. Further, the way this variation occurs differs for each photosensitive drum. That is, as the drums are worn, the surfaces of the photosensitive drums 1*a* and 1*b* cease to attain a desired potential, and, if image exposure is effected, decay to a desired potential ceases to occur, with the result that the characteristics of the electrostatic latent images formed on the photosensitive drums 1*a* and 1*b* are changed, resulting in a fluctuation in the tint of the image.

In the case of the image forming apparatus 103, there are three different distances to be covered before the developing portion 40*a*, 40*b* is reached after image exposure is effected on the surface of the photosensitive drum 1*a*, 1*b* charged by the primary charger 2*a*, 2*b*. It is assumed that the development characteristics of the developing devices 41 through 46 are substantially the same.

Figure 3:
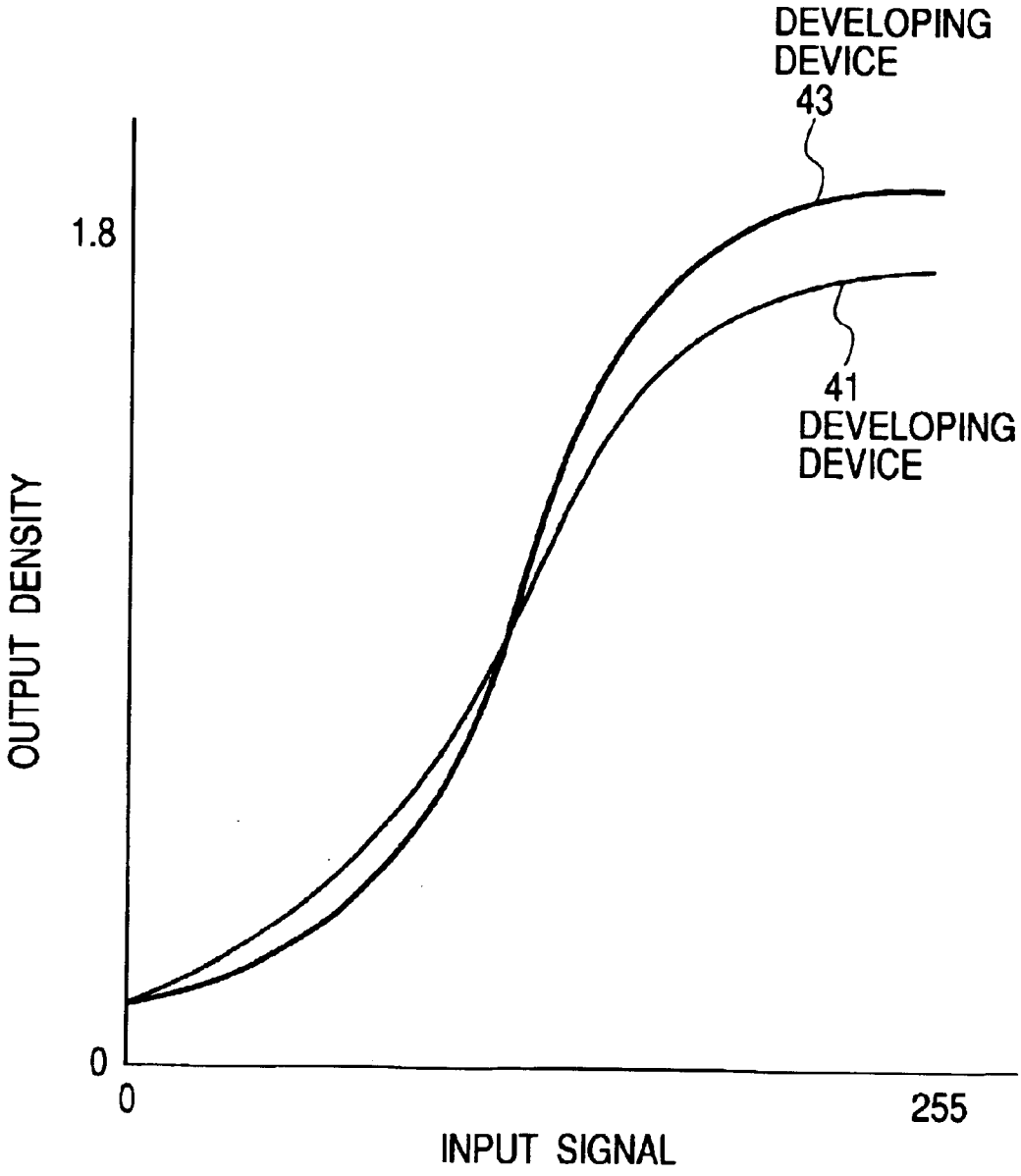
FIG. 3 is a graph comparing image outputs from a developing device 43 farther from an electrostatic position and from a developing device 41 nearer thereto.

Based on the above description, FIG. 3 shows the difference in gradation characteristics between the developing device 41 nearer to the exposure position 38*a* and the developing device 43 farther from the same in the image forming means Sa provided in the image forming apparatus 103 when exposure is performed under high temperature and humidity.

In FIG. 3, the horizontal axis indicates an input image density signal (a density signal for an image input to the image forming apparatus (256 levels of gray)), and the vertical axis indicates output image density (the density of the image formed on the recording material based on the input image density signal (dimensionless)). As shown in FIG. 13, the developing device 43 is situated farther from the exposure position than the developing device 41, so that the potential decay amount is larger in the former. At the same time, the lateral dispersion of the potential also occurs to a larger degree and the electrostatic latent image spread, resulting in a so-called blur in the electrostatic latent image. Thus, in FIG. 3, the potential decay amount increases, whereby the contrast in development is enhanced.

Thus, the developing device 43 exhibits a higher output density with respect to the input signal. Further, due to the blur in the electrostatic latent image, the developing device 43 exhibits a lower contrast in development in the low-density portion, that is, the so-called highlight portion, resulting in a low density.

Further, when such differences are generated in each of the two image forming means Sa and Sb, there are generated six different development characteristics in total, making it difficult to restrain the fluctuation in tint.

As is generally known, the difference in gradation characteristics in output image is corrected by a look-up table processing portion for optimization. Further, it is also possible to perform control to even up the line widths of thin lines.

However, since these relationships vary depending upon the environmental conditions (temperature, humidity, etc.), control has to be performed very frequently. Further, in actuality, it is considerably difficult to realize a perfectly ideal control, and some errors are inevitably involved. Any errors will directly result in a variation in tint, which should impair the quality of the full color image.

In view of this, in the image forming apparatus of the embodiment of the present invention shown in FIG. 1, the developing devices 41 through 46 are mounted on movable members (development rotaries) which are rotary developing device retaining devices such that the developing devices 41, 42, and 43 are mounted on the development rotary 4*a* in the image forming means Sa, and that the developing devices 44, 45, and 46 are mounted on the development rotary 4*b* in the image forming means Sb, development for the photosensitive drums 1*a* and 1*b* being performed by the common developing portions 40*a* and 40*b*. As a result, the conditions for the electrostatic latent images at the developing portions 40*a* and 40*b* are substantially the same, so that it is possible to prevent a variation in gradation characteristics mainly due to blur in the electrostatic latent images at the developing portions 40*a* and 40*b*.

Further, also between the two photosensitive drums 1*a* and 1*b*, the distance between the charging position (charger 2*a*, 2*b*) and the image exposure position 38*a*, 38*b*, and further, the distance between the image exposure position 38*a*, 38*b* and the developing portion 40*a*, 40*b* are made substantially the same, whereby the electrostatic latent images can be formed substantially in the same manner on the two photosensitive drums, thereby making it possible to make the charging bias, development bias, etc. common between the two drums. That is, it is possible to restrain a fluctuation in tint with a construction simpler than that in the prior art.

Further, if the user so desires, the development rotaries 4*a* and 4*b* to which the developing devices 41 through 46 are attached are interchangeable. In this case also, when the developing devices perform development at the common developing portions 40*a* and 40*b*, it is possible to prevent generation of a defective image as mentioned above.

Further, if the user so desires, it is possible to detach a developing device which has been used and to attach instead a developing device of the same configuration containing a different developer, such as a gold toner. In this case also, the developing devices perform development at common developing portions, so that it is possible to prevent generation of a defective image as mentioned above.

Thus, if the same control as in the conventional image forming apparatus is performed, the output image quality fluctuation factors are reduced, thereby making it possible to obtain images of higher quality.

Further, when, as in the prior art, control is performed so as to change various settings for each developing device, it is necessary to provide a memory region for storing a control program, so that there are problems in that it is necessary to use a large-capacity memory requiring control time, resulting in a deterioration in throughput in image formation (an increase in first print time), and, further, an increase in the requisite time for developing an image forming apparatus.

In this image forming apparatus, however, the six developing devices 41 through 46 have substantially the same construction and configuration, with only the developers used therein being varied. This also constitutes a feature of this construction. In the image forming apparatus 103, the positional relationship between the photosensitive drums 1*a* and 1*b* and the developing devices 41 through 46 vary depending upon the developing portions 40*a* and 40*b*, so that as compared with the case in which the configurations of the developing devices 41 through 46 differ according to their positions, this not only helps to achieve a reduction in cost, but also makes it possible to unify the development of the developing devices. From this viewpoint also, it is possible to achieve uniformalization in the development characteristics constituting the image fluctuation factors. Thus, it is possible to achieve an improvement in image quality and a reduction in development time.

Figure 11:
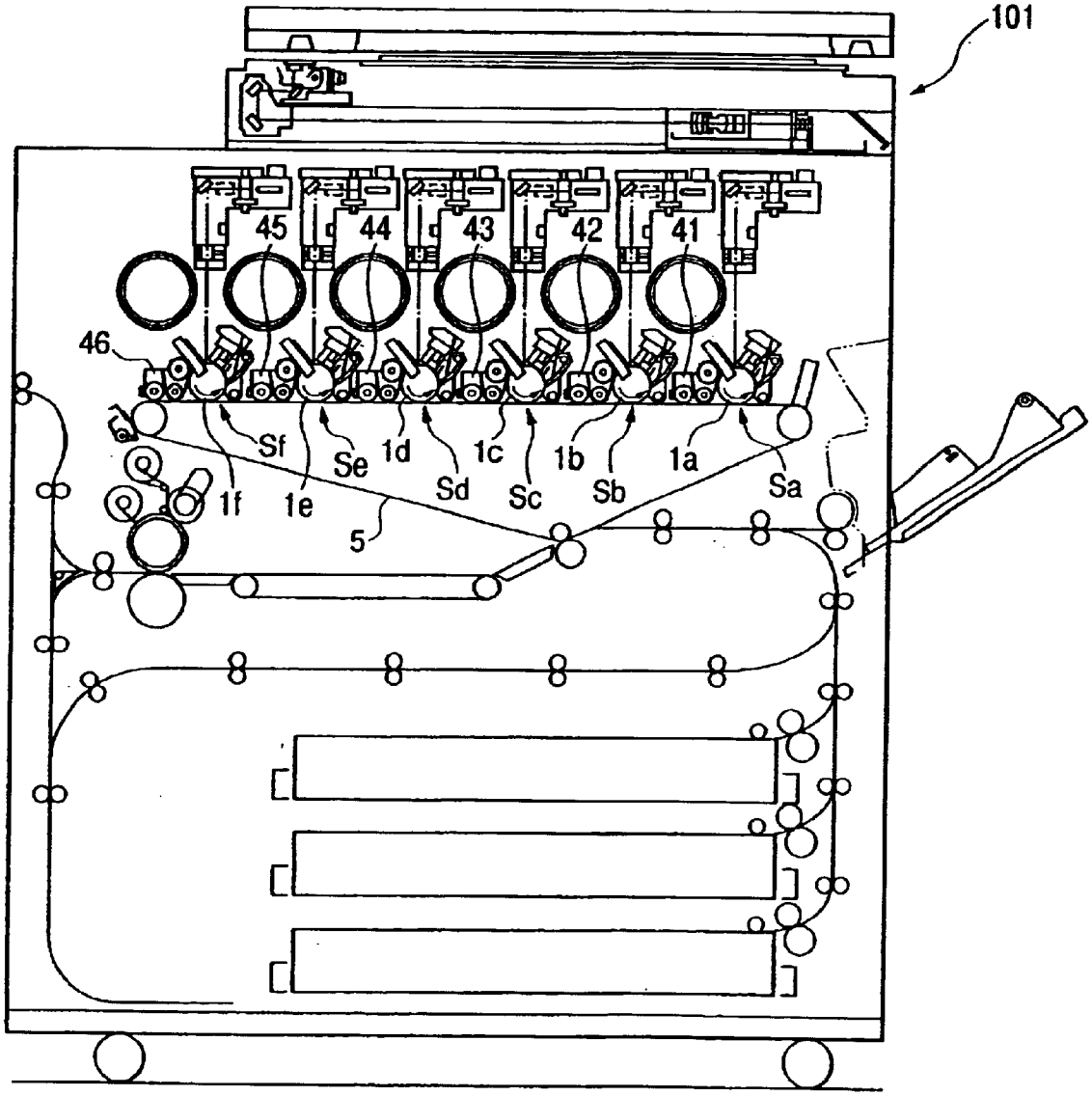
PRIOR ART FIG. 11
FIG. 11 is a schematic diagram showing a construction of a conventional image forming apparatus.

Further, as compared with the other image forming apparatuses than the image forming apparatus 103, e.g., the image forming apparatus 101 shown in FIG. 11 using six photosensitive drums 1*a* through 1*f*, it is possible to achieve a reduction in the size (in particular, the lateral width) of the image forming apparatus.

Figure 12:
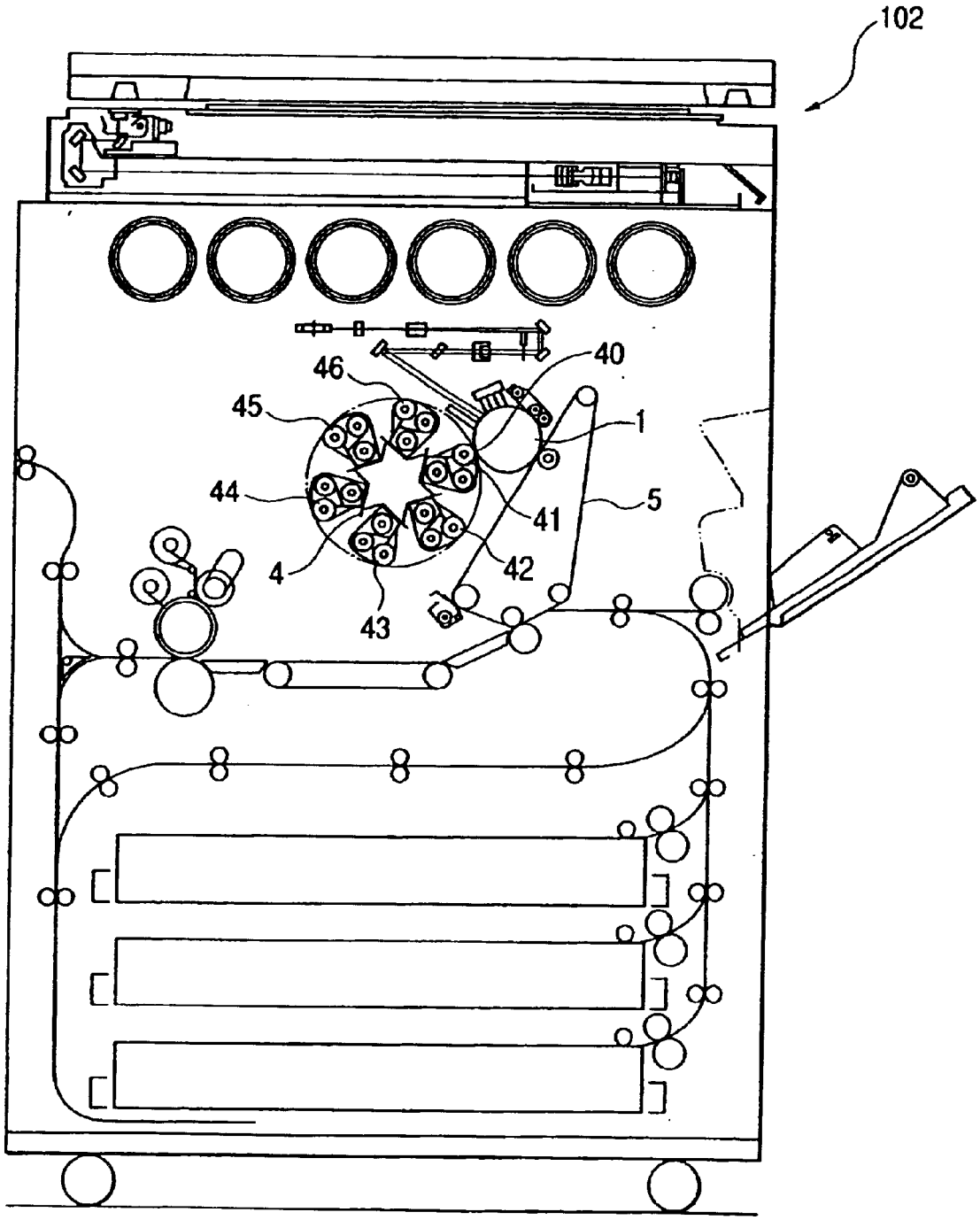
PRIOR ART FIG. 12
FIG. 12 is a schematic diagram showing a construction of another conventional image forming apparatus.

When a full color image is to be formed by using toners of the six colors, this embodiment adopts an arrangement in which the toner images formed on the photosensitive drums 1*a* and 1*b* by the image forming means Sa and Sb are alternately transferred to the intermediate transfer belt 5 for superimposition, and in which it is only necessary for the intermediate transfer belt 5 to pass the primary transfer portion three times, so that, as compared with the image forming apparatus 102 shown in FIG. 12 (in which it is necessary for the intermediate transfer member to pass the primary transfer portion six times), it is substantially possible to double the image output rate assuming that the rotating speed (peripheral speed) of the photosensitive drums is the same.

Further, as compared with the image forming apparatus 102 shown in FIG. 12, according to this embodiment, it is possible to reduce the number of rounds that the intermediate transfer belt has to make when forming a full color image using toners of six colors, so that this embodiment is superior in terms of the durability of the photosensitive members and the intermediate transfer member.

Further, the six developing devices include ones containing magenta and cyan toners of high density (with a larger pigment amount) and of low density (with a smaller pigment amount), whereby it is possible to mitigate the granulation property, making it possible to provide an image of still higher quality.

Further, for yellow also, it is possible to use a toner of high density (with large pigment amount) and a toner of low density (with small pigment amount). By performing image formation using these toners, it is possible to achieve a reduction in granularity and to attain a further improvement in image quality. In this case, the number of developing devices uses is seven, which means three developing devices are arranged on one development rotary and four on the other.

Further, by using toners of special colors, such as gold, silver, and a fluorescent color, it is possible to achieve a high image quality in conformity with the taste of the user and the particular use. When use of such special color toners requires nine developing devices, three photosensitive members as described above are provided, and development rotaries (on each of which three developing devices are mounted) are arranged for these three photosensitive members.

As described above, by providing a plurality of developing devices for each of a plurality of photosensitive drums, it is possible to reduce the size of the image forming apparatus and reduce the number of parts to thereby achieve a reduction in cost as compared with the case in which the number of developing devices is the same as the number of photosensitive drums. Further, as compared with the case of an image forming apparatus which has a single photosensitive drum and a number of developing devices for the same, it is possible to realize an image output at higher speed.

Thus, it is possible to provide a small and inexpensive image forming apparatus capable of providing high quality images at high speed.

While in this example an intermediate transfer belt is used as the transfer medium to which developer images are transferred from the first photosensitive drum and the second photosensitive drum, it is also possible to adopt an intermediate transfer drum. Further, the present invention is also applicable to a construction in which developer images formed by the image forming means Sa and the image forming means Sb are alternately transferred in superimposition to the recording material (transfer medium) borne by a transport belt or the like serving as the recording material bearing member.

As described above, in this embodiment, the distance from the exposure position on the image bearing member to the developing portion is always fixed, whereby it is possible to perform development in a satisfactory manner independently of the kind of developer accommodated in the developing device, making it possible to provide a small and inexpensive image forming apparatus capable of providing high quality images at high speed.

Further, it is possible to restrain, with a simple construction, fluctuation in the tint of the image formed.

Further, it is possible to make the configurations of the developer substantially the same, thereby making it possible to achieve a reduction in cost. That is, it is easier to uniformalize the characteristics of the developer images formed with different developers, with the result that it is possible to output a high quality image.

Further, by using deep-color and light-color developers with different contained-pigment amounts, it is possible to achieve a reduction in the granularity of the image formed, making it possible to attain a dramatic improvement in the reproducibility of a fine image representing a human skin or the like.

Furthermore, by using special color toners, such as gold, silver, and fluorescent toners, it is possible to obtain an image in conformity with the taste of the user and the particular use while achieving an improvement in image quality.

Embodiment 2

The construction of Embodiment 2 is substantially the same as that of Embodiment 1 except the following points, so that a detailed description of the image forming apparatus will be omitted. Embodiment 2 greatly differs from Embodiment 1 in that the colors of the toners accommodated in the developers arranged in correspondence with the photosensitive members are changed.

That is, in this embodiment, of the developing devices 41 through 46, the developing device 41 contains deep-magenta toner, the developing device 42 contains light-magenta toner, the developing device 43 contains yellow toner, the developing device 44 contains deep-cyan toner, the developing device 45 contains light-cyan toner, and the developing device 46 contains black toner.

Here, an image forming method using deep-color and light-color toners will be described.

In this embodiment also, deep-color and light-color toners are prepared for cyan and magenta. By achieving a reduction in granular feel in cyan and magenta, it is possible to substantially reduce the granular feel of the entire image.

The densities of the deep-color and light-color toners for cyan and magenta are adjusted through pigment amount adjustment such that that of the deep-color toner is 1.6 for 0.6 mg/cm$^2$ while that of the light-color toner is 0.8 for 0.6 mg/cm$^2$.

By performing image formation while properly combining (mixing) the deep-color and light-color toners with each other for magenta and cyan, that is, while maintaining a satisfactory gradation property for magenta and cyan, it is possible to reduce the granular feel in the low density portion while minimizing the toner consumption in the high density portion.

Figure 5:
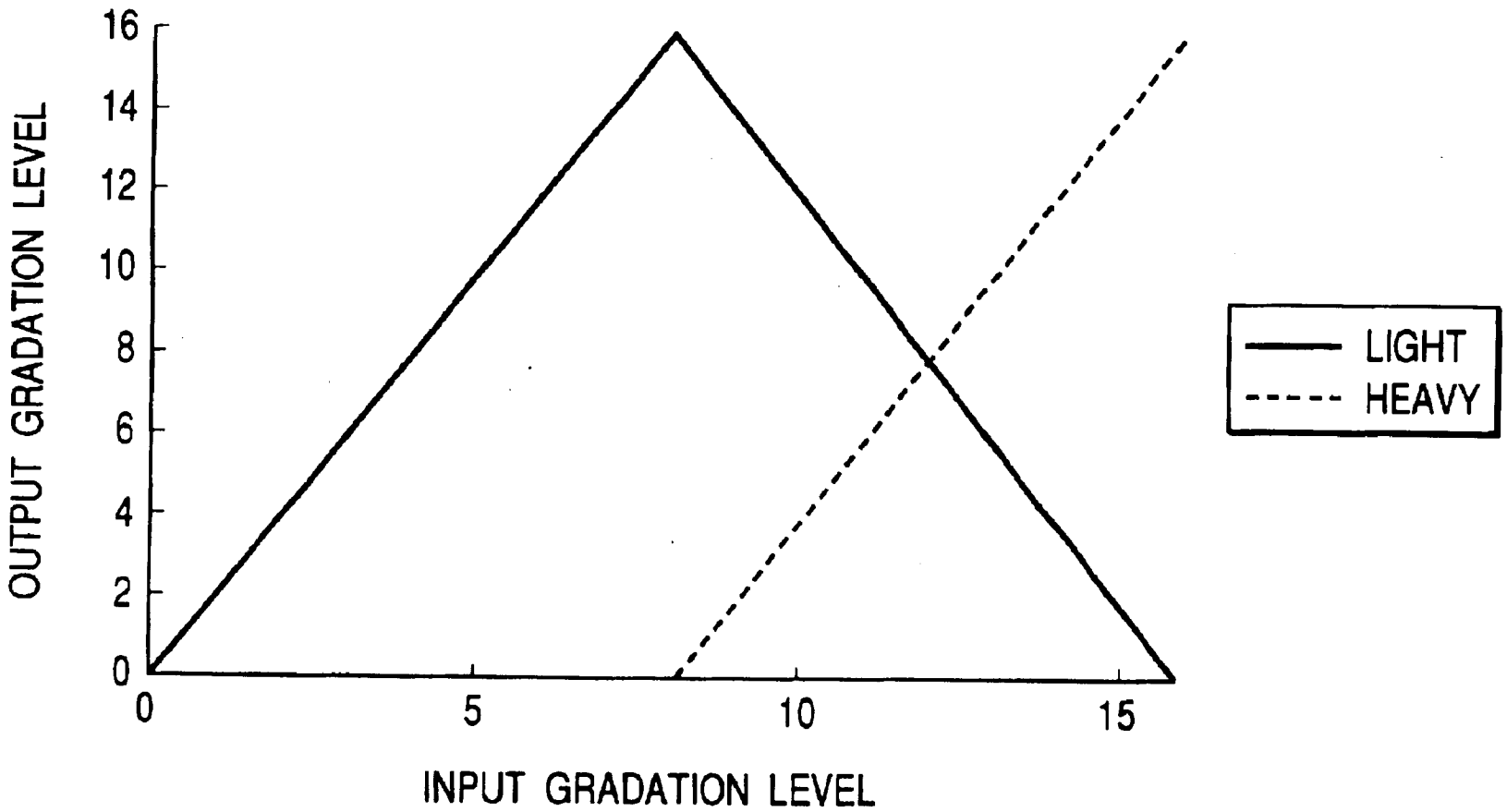
FIG. 5 shows input/output characteristics of images formed by deep-color and light-color toners of the same hue.

As shown in FIG. 5, in this embodiment, the output image density is adjusted by mixing the deep-color and light-color toners with each other.

In the case of the image forming apparatus as shown in FIG. 12, which is equipped with a single image bearing member 1, when an exposure device 3 such as a laser beam scanner is provided, regarding the main scanning direction (laser scanning direction), it is only necessary for the polygon rotation to be constant and for the laser write timing to be matched with the rotation, so that control is performed so as to match the write timing. Regarding the sub-scanning direction also, it is only necessary for the write timing to be fixed with respect to the position of the image bearing member 1, so that time control is performed so as to make the write timing fixed.

In contrast, in the case of an image forming apparatus using a plurality of image bearing members, it is necessary to constantly correct the positional relationship between the image bearing members in both the main scanning direction and the sub-scanning direction. Thus, some marks for color drift correction are drawn, and the positional relationship therebetween is read for correction of the laser writing, etc.

Due to this arrangement, it is possible to form an image with six different toners independently of the number of image bearing members.

Further, in forming a color image, the screen angle of a halftone screen has conventionally been set at a different value for each color in order to prevent moire. For example, the following combination is known: 15 degrees for cyan, 75 degrees for magenta, 0 degree for yellow, and 45 degrees for black.

In some electrophotographic image forming apparatuses, e.g., CLC 1150 series by Canon Inc., image formation is effected with the same screen angle (90 degrees) for all the four colors. This arrangement is adopted due to the fact that the image bearing member constitutes a system which is relatively free from misregistration. Generally speaking, in an image forming apparatus using a plurality of image bearing members, this system, in which the same screen angle is used for the four colors, is not likely to be adopted since it is subject to generation of moire.

However, when images are to be formed using six different toners with different screen angles for each image in order to prevent moire, the angle setting is very difficult to perform. The closer the spatial frequencies, the more intense is the moire generation. Thus, when the screen angles are close to each other, moire is likely to be generated.

On the other hand, when image formation is to be performed with the same screen angle in order to avoid moire generation due to screen angle, it is performed on the precondition that the colors involve no color drift. If misregistration drift is generated, unevenness in color is generated in that portion, thereby greatly impairing the image quality.

The larger the number of image bearing members, the more likely is misregistration to occur. Thus, image quality tends to be improved with a smaller number of image bearing members.

However, when the number of image bearing members is small, there is a problem that the larger the number of colors, the more reduced the productivity. Even when a plurality of image bearing members are provided, it might be possible to obtain a high quality image by performing precise control to prevent misregistration. That, however, would involve a considerable increase in cost.

In view of this, in the image forming apparatus of this embodiment using deep-color and light-color toners, screen angle setting is performed as follows. Since cyan, magenta, yellow, and black are different in hue, image formation is performed with different screen angles.

Figure 4:
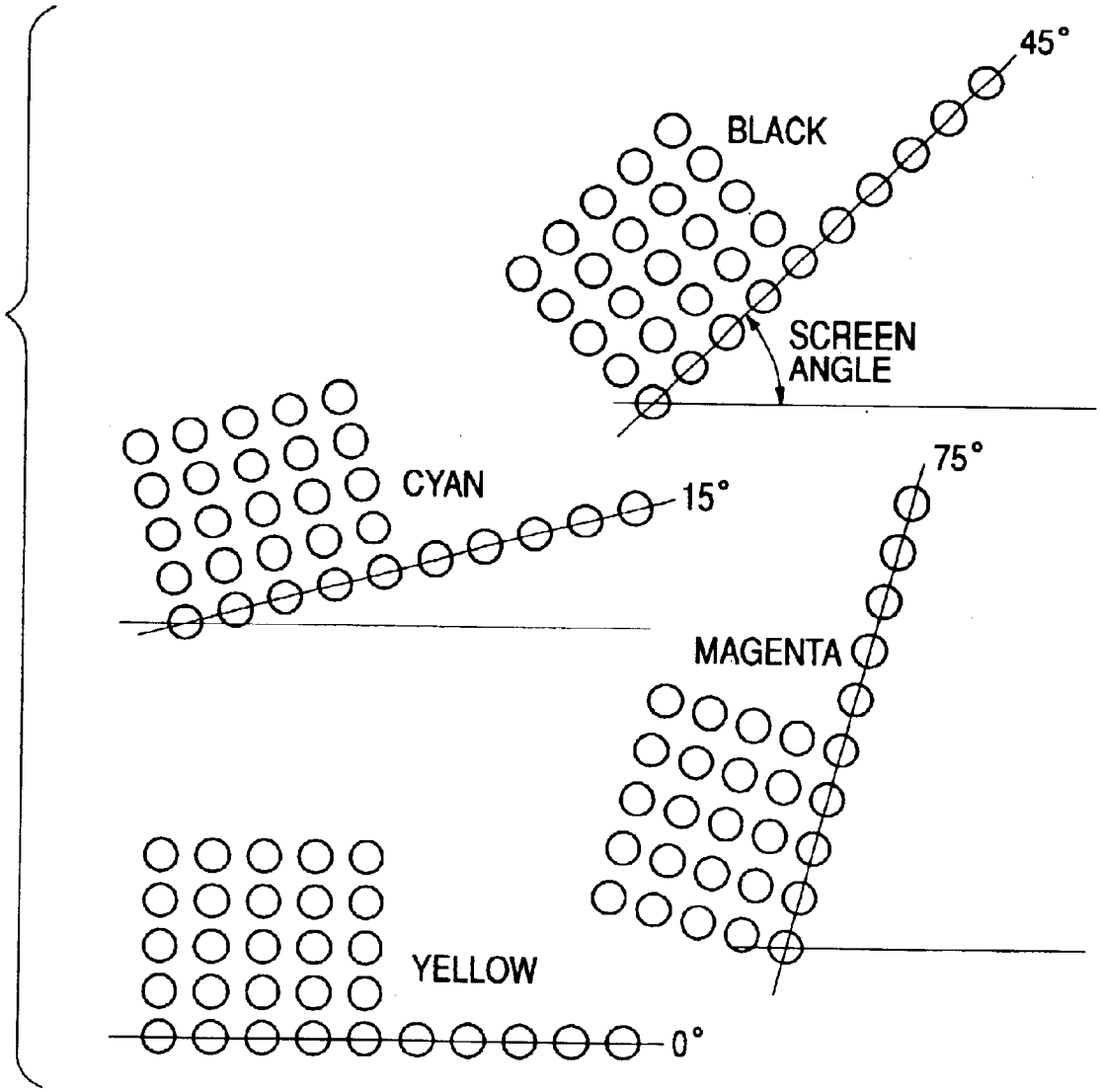
FIG. 4 shows a halftone screen angle.

Due to the construction in which image formation is performed using six different toners, adoption of different screen angles for the deep-color and light-color toners makes it difficult to realize a screen angle setting capable of avoiding moire, so that the setting as shown in FIG. 2 is adopted. Here, the screen angle means the angle of the centroidal line of a screen pattern with respect to the horizontal line in FIG. 4.

The screen angle is 15 degrees for deep and light cyans, 75 degrees for deep and light magentas, 0 degree for yellow, and 45 degrees for black. Here, it is for the purpose of minimizing generation of moire in the image that the same screen angle is adopted for colors of the same hue and different tones as in the case of cyan and magenta.

In the present invention, a color range having a common hue regarded as the range of the same hue as long as they can be called the same color in terms of the usual concept of color, that is, as long as they can be identified as, for example, cyan, magenta, yellow, or black. In this embodiment, toners of four hues (cyan, magenta, yellow, and black) are used, so that the spectral characteristics of each of the colors: cyan, magenta, yellow, and black, are in the range identifiable as a particular color.

In this way, when image formation is performed with the same screen angle for toners of the same hue and different tones, moire is likely to be generated. This is naturally restricted to the case in which image formation is performed with two toners of different tones simultaneously. When image formation is to be performed using toners of different tones, the image forming apparatus is designed in a simple manner such that the input and output characteristics of the toner depth as shown in FIG. 3 are obtained. Due to such a design, when image formation is performed using both deep and light toners, the region subject to moire generation is restricted to the image portion of somewhat high density expressing halftone density.

In contrast, in the case of two toners of different hues, such as cyan and magenta, it is highly possible that both toners are used for the formation of a full color image. That is, when image formation is performed using two toners of different hues, it is not very likely that two toners of the same hue and different tones are used for the image formation, which is suitable for a combination in which the screen angles are matched with each other.

However, even so, misregistration is generated and, at the same time, moire is likely to be generated in the image forming portion, so that, in the present invention, to minimize misregistration, two developing devices for two toners of the same hue and different tones are arranged for the same photosensitive drum (that is, two developing devices for toners of the same hue and different tones perform development on an electrostatic image on the same photosensitive drum), whereby misregistration generation is minimized.

As compared with the case where different image bearing members are used, the arrangement of two developing devices for toners of the same hue and different tones for the same photosensitive drum provides the following advantage in terms of color drift prevention.

That is, when the developing devices are arranged for the same photosensitive drum, regarding the main scanning direction, color drift generation can be prevented solely by properly adjusting the write timing with respect to the rotation of the polygon mirror. Further, regarding the sub-scanning direction, in the case of decentering of the image bearing member, misregistration can be restrained by properly adjusting the write timing with respect to the position of the image bearing member.

In contrast, if misregistration between different photosensitive drums is to be restrained, a difference in the degree of eccentricity due to the individual difference between the photosensitive drums, deviation of the main scanning position (deviation of the polygon application position), etc. can only be corrected by other means, such as phase matching for the photosensitive drums or control of the write position with respect to the polygon mirror. Moreover, since it is difficult to perfectly suppress misregistration by the correction, an error is generated in the control.

Thus, when two developing devices for toners of the same hue and different tones are arranged for the same photosensitive drum, it is possible to reduce color drift as compared with the case in which two developing devices for toners of the same hue and different tones are arranged respectively for different photosensitive drums.

As described above, in an image forming apparatus having two image bearing members and using six toners inclusive of a combination of toners of the same hue and different tones, four screen angles little allowing moire generation are used, the same screen angle is set for the combinations of toners of different tones for cyan and magenta, and image formation is performed with the same image bearing member, whereby it is possible to provide an image forming apparatus capable of outputting a high quality image free from moire at low cost and at high speed.

While in this embodiment, two image bearing members are used, it is essentially effective to set the same screen angle for the combination of toners of different tones independently of the number of image bearing members. When, in this construction, image formation is performed with the same image bearing member using a combination of toners of different tones, a further improvement is achieved in terms of image quality.

Embodiment 3

Figure 6:
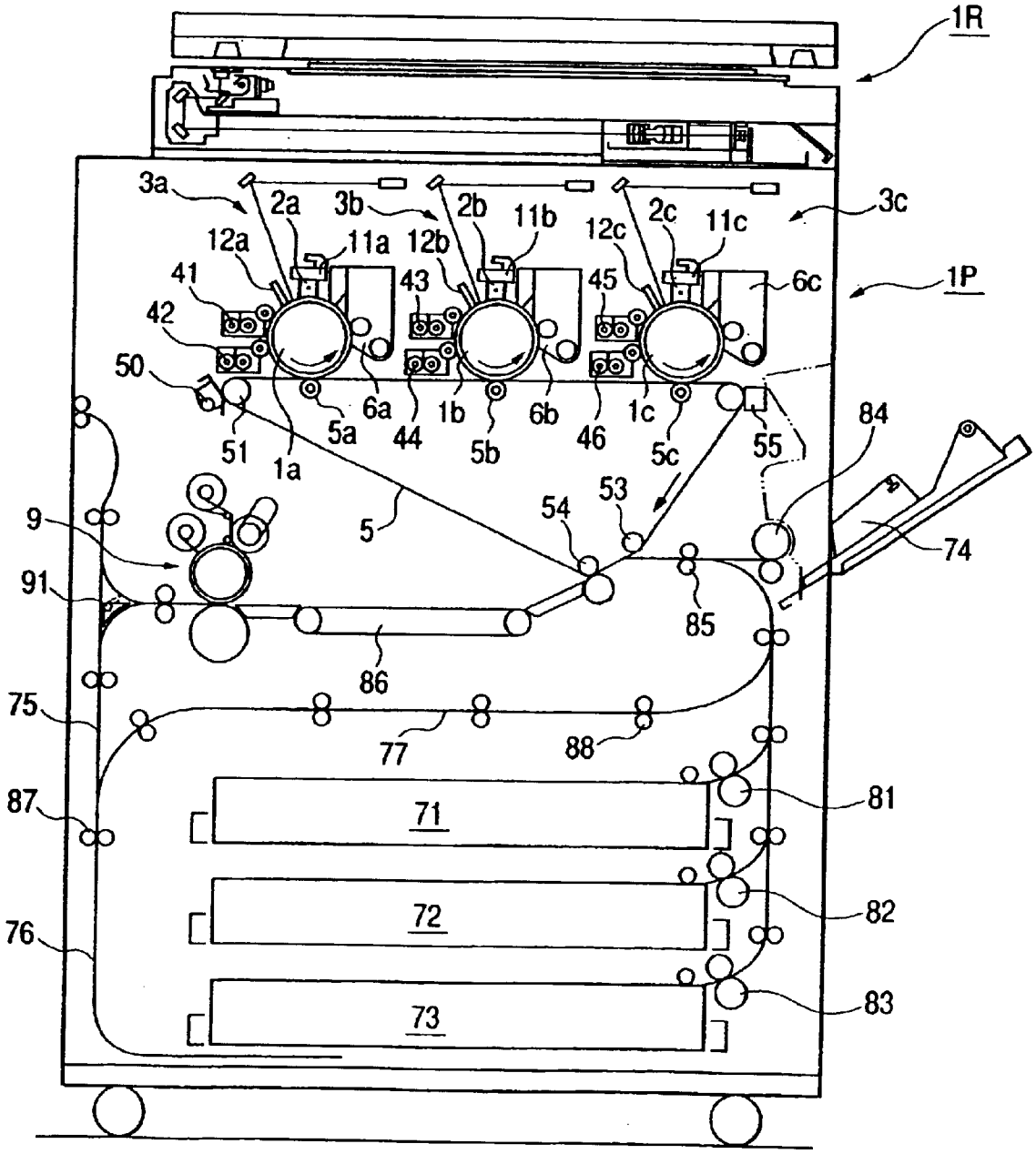
FIG. 6 is a schematic sectional view showing a construction of a full color image forming apparatus.

FIG. 6 is a schematic sectional view showing a construction of an image forming apparatus according to Embodiment 3. As shown in FIG. 6, the image forming apparatus of this embodiment has six developing devices and three photosensitive drums serving as image bearing members.

In this embodiment, in the printer portion 1P, the three photosensitive drums 1*a*, 1*b*, and 1*c* serving as the image bearing members are held so as to be rotatable in the direction of the arrow shown in the figure, and, respectively arranged around the photosensitive drums 1*a*, 1*b*, and 1*c* are pre-exposure lamps 11*a*, 11*b*, and 11*c*, corona primary chargers 2*a*, 2*b*, and 2*c*, laser exposure optical systems 3*a*, 3*b*, and 3*c*, and potential sensors 12*a*, 12*b*, and 12*c*. Further, arranged around each of the photosensitive drums 1*a*, 1*b*, and 1*c* are two developing devices 41 and 42, 43 and 44, 45 and 46, a transfer device 5*a*, 5*b*, 5*c*, and a cleaning device 6*a*, 6*b*, 6*c*.

Otherwise, the construction of this embodiment is the same as that of Embodiments 1 and 2, so that the components of the same construction and operation are indicated by the same reference numerals, and a repetitive description of such components will be omitted.

In this embodiment, due to the provision of the three photosensitive drums 1*a*, 1*b*, and 1*c*, that is, three image bearing members, image formation using six toners is possible by causing the intermediate transfer member, that is, the intermediate transfer belt 5, to make two rounds. Thus, as compared with the image forming apparatus with two image bearing members, as in Embodiments 1 and 2, in which it is necessary for the intermediate transfer belt to make three rounds, it is possible to achieve a productivity 1.5 times higher based on a simple calculation.

In this embodiment, the following combinations of the developing devices with respect to the image bearing members are possible: the developing devices 41 and 42 for deep and light cyans, the developing devices 43 and 44 for deep and light magentas, and the developing devices 45 and 46 for yellow and black.

Further, as in Embodiment 2, the screen angles are set as follows: 15 degrees for the deep and light cyans, 75 degrees for deep and light magentas, 0 degree for yellow, and 45 degrees for black.

Due to this combination, it is possible to minimize the influence of color drift while minimizing moire generation.

As described above, according to this embodiment, in an image forming apparatus having three image bearing members and using six toners including a combination of toners of different tones, four screen angles hardly allowing moire generation are used, the same screen angles is set for the combinations of cyan and magenta toners of different tones, and image formation is performed with the same image bearing member, whereby it is possible to provide an image forming apparatus capable of outputting a high quality image free from moire at low cost and at high speed.

As described above, according to Embodiments 2 and 3, even in the case in which a plurality of image bearing members are provided, it is possible to output a high quality image at low cost and at high speed with toners of four or more colors including toners of the same hue and different tones. Further, by setting the same halftone screen angle for two images in toners of the same hue and different tones, it is possible to output at low cost and at high speed a high quality image involving little moire and relatively free from the influence of color drift.

Embodiment 4

Prior to the description of Embodiment 4, the colors of developers (toners) and image quality will be first discussed.

In the case of subtractive color mixture, cyan, magenta, and yellow are said to be the three primary colors. When mixed together, the three colors are turned into gray (achromatic color).

Further, basically, all the colors can be obtained through various proportions of cyan, magenta, and yellow.

Thus, in order that such proportions may not be disturbed, various measures are taken for stable reproduction of each color.

However, an image forming apparatus having a plurality of image bearing members has a problem in that such color balance is easily disturbed.

For example, if the density of each color (cyan, magenta, or yellow) is well-balanced at the longitudinal center of the image bearing member, any unevenness in sensitivity in the image bearing member or any unevenness in light quantity in the exposure device will cause the color balance at an image end portion to deteriorate.

In view of this, control is performed to uniformalize the light quantity of the exposure device in the longitudinal direction or to correct the exposure amount in conformity with the sensitivity of the image bearing member.

However, correction of peripheral unevenness and other short-term-fluctuation factors in a latent image involves a difficult problem concerning an increase in memory capacity for correction control, a complicated system, execution of a repeated correction control, etc.

In view of this, this embodiment aims to solve the above problems to prevent a deterioration in gray balance.

The basic construction of the image forming apparatus of this embodiment described below is the same as that of Embodiment 1, so that a detailed description thereof will be omitted. This embodiment differs greatly from Embodiment 1 in that the colors of the toners contained in the developing devices arranged in correspondence with the photosensitive members are changed.

That is, in this embodiment, of the developing devices 41 through 46, the developing device 41 contains cyan toner, the developing device 42 contains magenta toner, the developing device 43 contains yellow toner, the developing device 44 contains a special-color toner, the developing device 45 contains a special-color toner, and the developing device 46 contains black toner.

Examples of the special-color toners to be contained include metallic type toners, such as gold and silver toners, and a toner containing fluorescent agent.

Further, while in this embodiment the developing devices 41 through 46 contain dual-component developers in which toners and carriers are mixed together, it is also possible to use mono-component toners consisting of toners alone.

Further, while in this embodiment the number of developing devices is six, there is no limitation regarding the number of developing devices as long as it is more than four (which is the number of developing devices in the conventional image forming apparatus using yellow, magenta, cyan, and black toners).

Here, a concept regarding color balance will be discussed.

In the case of this image forming apparatus, color expression is made mainly through a combination of cyan, magenta, and yellow. In many cases, a special-color toner is used alone.

Suppose the three colors of cyan, magenta, and yellow are assigned to different image bearing members.

For example, a case deviating from the above description will be considered, in which developing devices respectively containing cyan and magenta toners are arranged for the first image bearing member 1*a* and in which a developing device containing yellow toner is arranged for the second image bearing member 1*b*.

In this case, if the characteristics of the image bearing members 1*a* and 1*b*, the characteristics of the exposure devices, etc. were completely the same, no problem would be involved in effecting color expression through color mixing. In reality, however, some differences are allowed to be generated.

Figure 7:
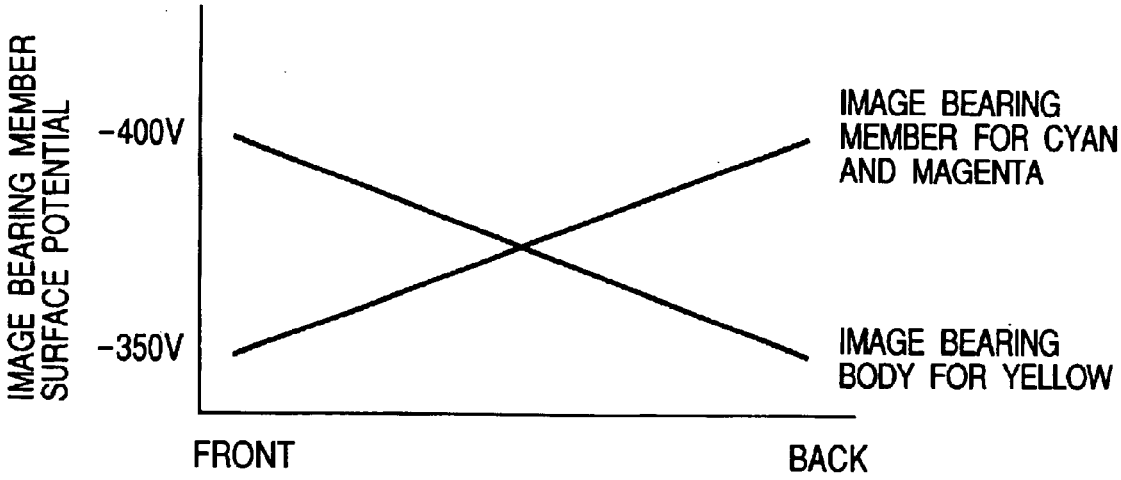
FIG. 7 shows unevenness in sensitivity in a longitudinal direction of an image bearing member.

For example, suppose the image bearing members 1*a* and 1*b* involve unevenness in sensitivity characteristics as shown in FIG. 7. In FIG. 7, the vertical axis indicates the image bearing member surface potential at the time of exposure at 128 levels of gray corresponding to the halftone region (in the case of 256 levels of gray), and the horizontal axis indicates the position of the image bearing member from the front to the back (the longitudinal position).

Figure 8:
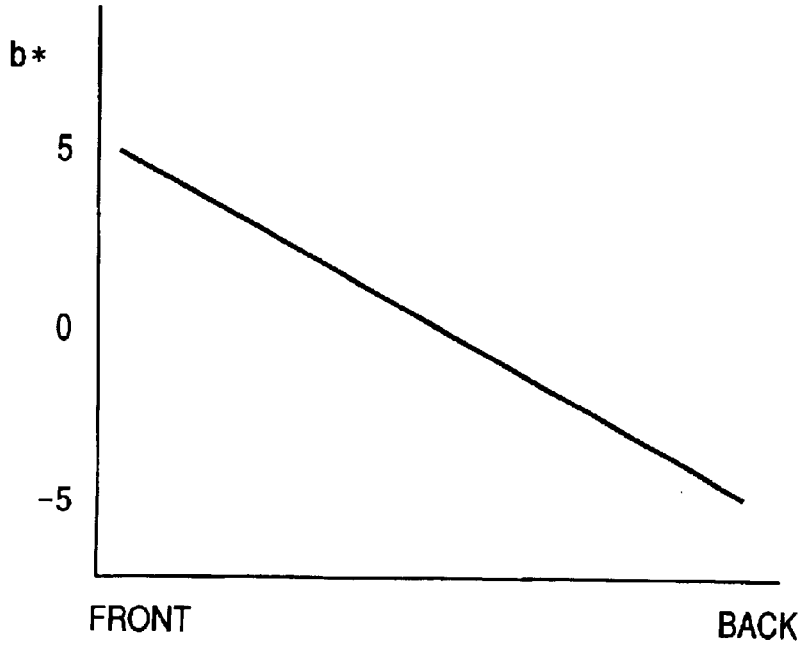
FIG. 8 shows a b* variation in the longitudinal direction when gray images are formed on different image bearing members using toners of three colors.

When an achromactic-color (gray) image is formed with this image bearing member 1*a*, 1*b*, by using the three chromatic colors of cyan, magenta, and yellow, b* characteristic as shown in FIG. 8 (b* of CIE L*a*b*) is obtained. That is, while b* is 0 in natural gray, the resultant gray is colored as shown in FIG. 8.

This phenomenon leads to a deterioration in image quality. Thus, in order that the color balance may not be changed due to variation in the image bearing member and the exposure device, in this embodiment, the developing devices 41, 42, and 43 respectively containing cyan, magenta, and yellow toners are arranged for the same image bearing member 1*a*.

Figure 9:
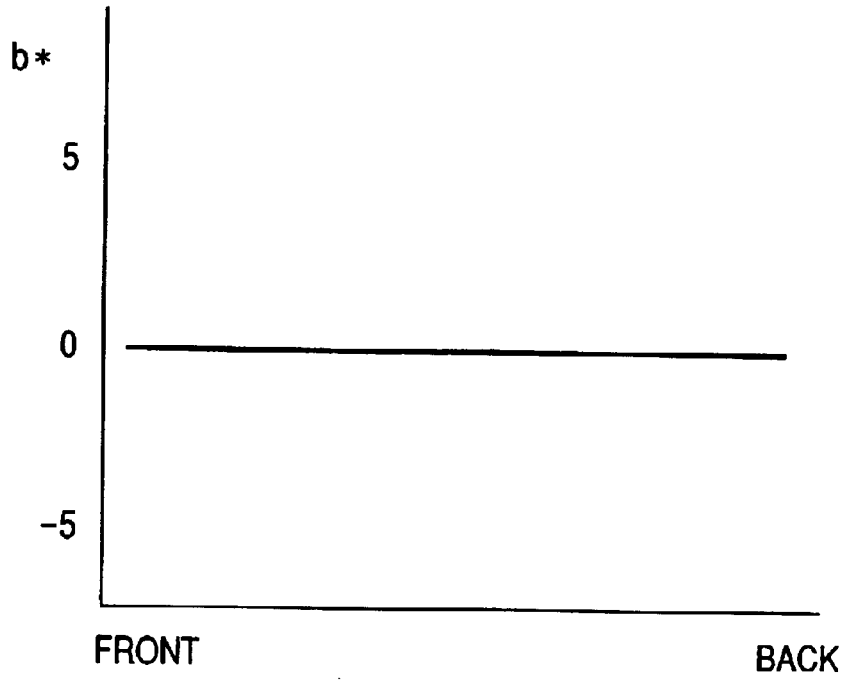
FIG. 9 shows the b* variation in the longitudinal direction when gray images are formed on the same image bearing member using toners of three colors.
Figure 10:
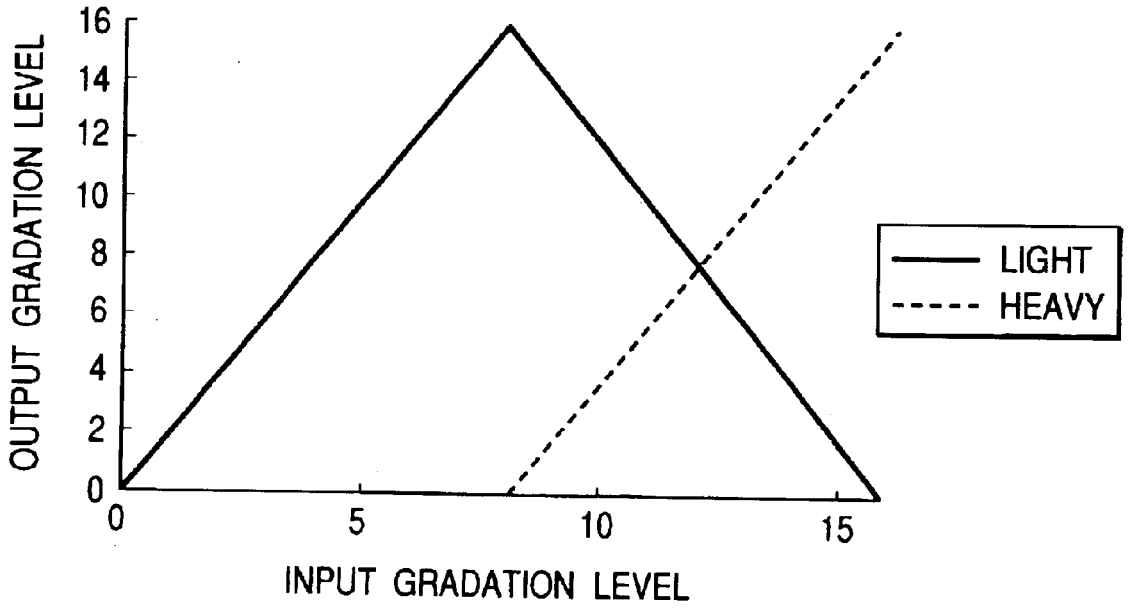
FIG. 10 shows the input/output characteristics of images formed by using deep-color and light-color toners of the same hue.

Thus, in this embodiment, even if there is unevenness in sensitivity in the image bearing member 1*a* for cyan and magenta, the b* component of the gray formed from the three colors is constant as shown in FIG. 9. On the other hand, the L* characteristic is not fixed. However, due to the elimination of color heterogeneity, it is possible to achieve a considerable improvement in terms of visual impression to the user.

Actually, this applies not only to gray, but also to other colors that can be obtained by mixing cyan, magenta, and yellow. By arranging developing devices containing cyan, magenta, and yellow toners for the same image bearing member, it is possible to substantially reduce the possibility of color heterogeneity generation as compared with the case in which image formation is performed with a plurality of image bearing members using the above three kinds of toner.

Apart from the above-mentioned unevenness in sensitivity, the image bearing member and the peripheral components thereof involve other kinds of factors for generating unevenness, such as unevenness in layer thickness of the image bearing member, unevenness in exposure amount of the exposure device, unevenness in spot diameter, and unevenness in charging by the charger, for all of which the measures of this embodiment prove effective.

From the technical point of view, it might be possible to correct color heterogeneity between a plurality of image bearing members by performing electrical shading or the like on the image bearing members. That, however, would require an improvement in component precision and in control precision, an increase in the capacity of memory for storing the control program, etc., resulting in an increase in cost.

In this way, the present invention advantageously helps to cope with color heterogeneity at low cost.

As described above, in an image forming apparatus equipped with two image bearing members and adapted to perform image formation using six kinds of toner, developing devices respectively containing at least cyan, magenta, and yellow toners are arranged for the same image bearing member, whereby it is possible to provide an image forming apparatus capable of outputting a high quality image free from color heterogeneity at low cost and at high speed.

Embodiment 5

An image forming apparatus according to Embodiment 5 of the present invention will now be described.

Since the description of the image forming apparatus of Embodiment 1 shown in FIG. 1 is applicable to this embodiment, a detailed description of the image forming apparatus of this embodiment will be omitted. This embodiment differs greatly from Embodiment 1 in the colors of the toners contained in the developing devices.

That is, in the image forming apparatus of this embodiment, the developing device 41 contains deep cyan toner, the developing device 42 contains deep magenta toner, the developing device 43 contains black toner, the developing device 44 contains light cyan toner, the developing device 45 contains light magenta toner, and the developing device 46 contains yellow toner.

Here, the toners of different tones will be discussed.

In this embodiment also, cyan and magenta toners of different tones are used. By reducing the granular feel in cyan and magenta, it is possible to substantially reduce the granular feel of the entire image.

The densities of the cyan and magenta toners are adjusted through pigment amount adjustment such that that of the deep-color toner is 1.6 for 0.6 mg/cm$^2$ while that of the light-color toner is 0.8 for 0.6 mg/cm$^2$.

By performing image formation while properly mixing these toners of different tones with each other, it is possible to reduce the granular feel in the low density portion while minimizing the toner consumption in the high density portion. FIG. 5 shows the general basic input/output characteristics of the toners of different tones.

In the case in which image formation is performed by thus mixing toners of different tones, the proportion of light-color toner is higher when gray is to be obtained.

Further, it is generally believed that the human eye is sensitive to difference in color in a bright portion, and, assuming that the difference in density is the same, the influence of difference in color is perceived more intensely in the case of a brighter color.

As described above, in this embodiment, when combining cyan, magenta, and yellow, instead of arranging developing devices containing deep cyan, deep magenta, and yellow toners for the same image bearing member as in Embodiment 4, developing devices containing light cyan, light magenta, and yellow toners are arranged for the same image bearing member.

That is, developing devices containing toners relatively close to each other in brightness are combined and arranged for the same image bearing member.

As described above, according to this embodiment, in an image forming apparatus having two image bearing members and using six kinds of toners including toners of different tones, developing devices containing light cyan, light magenta, and yellow toners, that is, developing devices containing toners relatively close to each other in brightness, are arranged for the same image bearing member, whereby it is possible to provide an image forming apparatus capable of outputting a high quality image free from color heterogeneity at low cost and at high speed.

As described above, according to Embodiments 4 and 5, it is possible to minimize disturbance in color balance, in particular, gray balance, and to output a high quality image free from color heterogeneity at low cost and at high speed.

Further, Embodiments 4 and 5 of the present invention can also be applied to an image forming apparatus (FIG. 13) in which stationary developing devices are arranged around each photosensitive member.

The present invention, of which Embodiments 1 through 5 have been described, allows various modifications in construction without departing from the scope of the gist of the invention.

What is claimed is:

1. An image forming apparatus comprising:

a first photosensitive member;

a plurality of first developing devices for developing an electrostatic latent image formed on said first photosensitive member with toner;

a first moving member provided with said plurality of first developing devices, for selectively positioning one of said plurality of first developing devices at said first photosensitive member;

a second photosensitive member;

a plurality of second developing devices for developing an electrostatic latent image formed on said second photosensitive member with toner;

a second moving member provided with said plurality of second developing devices, for selectively positioning one of said plurality of second developing devices at said second photosensitive member; and transferring means for transferring a first toner image formed on said first photosensitive member and a second toner image formed on said second photosensitive member onto a transferring medium such that the first toner image and the second toner image overlap, wherein said image forming apparatus can form an image in a condition that a developing device selected from among said plurality of first developing devices is replaced with a developing device selected from among said plurality of second developing devices.

2. An image forming apparatus according to claim 1, wherein the image forming apparatus can be changed from a first case to a second case, wherein, in said first case, said first moving member is provided with a first deep color developing device having deep color toner of a predetermined hue and a first light color developing device having light color toner of the predetermined hue, and said second moving member is provided with a second deep color developing device having deep color toner of other predetermined hue and a second light color developing device having light color toner of the other predetermined hue, and wherein, in said second case, said first moving member is provided with the first deep color developing device and the second deep color developing device, and said second moving member is provided with the second light color developing device and the first light color developing device.

3. An image forming apparatus according to claim 2, wherein the predetermined hue is magenta and the other predetermined hue is cyan.

4. An image forming apparatus comprising:

a first photosensitive member;

a plurality of first developing devices for developing an electrostatic latent image formed on said first photosensitive member with toner;

a second photosensitive member;

a plurality of second developing devices for developing an electrostatic latent image formed on said second photosensitive member with toner; and transferring means for transferring a first toner image with a first hue and a second toner image with a second hue different from the first hue onto a transferring medium such that the first toner image and the second toner image overlap, wherein at least one of said plurality of first developing devices and said plurality of second developing devices includes deep color toner of a predetermined hue, and at least one of said plurality of first developing devices and said plurality of second developing devices includes light color toner of the predetermined hue, wherein the first toner image and the second toner image are formed with different screen angles, wherein an image of the deep color toner of the predetermined hue and an image of the light color toner of the predetermined hue are formed with substantially the same screen angles, and wherein said at least one of said plurality of first developing devices and said plurality of second developing devices with the deep color toner of the predetermined hue and said at least one of said plurality of first developing devices and said plurality of second developing devices with the light color toner of the predetermined hue are provided to be used for a common photosensitive member.

5. An image forming apparatus according to claim 4, wherein the predetermined hue is magenta or cyan.

6. An image forming apparatus comprising:

a first photosensitive member;

a plurality of first developing devices for developing an electrostatic latent image formed on said first photosensitive member with toner;

a first moving member provided with said plurality of first developing devices, for selectively positioning one of said plurality of first developing devices at said first photosensitive member;

a second photosensitive member;

a plurality of second developing devices for developing an electrostatic latent image formed on said second photosensitive member with toner;

a second moving member provided with said plurality of second developing devices, for selectively positioning one of said plurality of second developing devices at said second photosensitive member; and transferring means for transferring a first toner image formed on said first photosensitive member and a second toner image formed on said second photosensitive member onto a transferring medium such that the first toner image and the second toner image overlap, wherein both a developing device having deep color toner with a predetermined hue and a developing device having light color toner with the predetermined hue are mounted on either of said first moving member or said second moving member.

7. An image forming apparatus according to claim 6, wherein said first moving member includes a developing device with deep color magenta toner and a developing device with light color cyan toner, and wherein said second moving member includes a developing device with deep color cyan toner and a developing device with light color magenta toner.

8. An image forming apparatus comprising:

a first photosensitive member;

a plurality of first developing devices for developing an electrostatic latent image formed on said first photosensitive member with toner;

a first moving member provided with said plurality of first developing devices, for selectively positioning one of said plurality of first developing devices at said first photosensitive member;

a second photosensitive member;

a plurality of second developing devices for developing an electrostatic latent image formed on the second photosensitive member with toner;

a second moving member provided with said plurality of second developing devices, for selectively positioning one of said plurality of second developing devices at said second photosensitive member; and transferring means for transferring a first toner image with a first hue formed on said first photosensitive member and a second toner image with a second hue different from the first hue formed on said second photosensitive member onto a transferring medium such that the first toner image and the second toner image overlap, wherein all of the plurality of developing devices respectively containing toners with different hues for being able to form an achromatic color by mixing the toners are mounted on either of said first moving member or said second moving member.

* * * * *